US005392483A

United States Patent [19]

Heinzelman et al.

[11] Patent Number: 5,392,483

[45] Date of Patent: Feb. 28, 1995

[54] MULTI-LEVEL BRISTLE TUFT TOOTHBRUSH

[75] Inventors: Bert D. Heinzelman, Tenafly, N.J.; Donald R. Lamond, Long Beach; John Moldauer, Brooklyn, both of N.Y.

[73] Assignee: Chesebrough-Pond's USA Co., Division of Conopco, Inc., Greenwich, Conn.

[21] Appl. No.: 271,697

[22] Filed: Jul. 7, 1994

[51] Int. Cl.[6] ..... A46B 9/04

[52] U.S. Cl. ..... 15/167.1; 15/DIG. 5

[58] Field of Search ..... 15/167.1, 167.2, DIG. 5; D4/104

[56] References Cited

U.S. PATENT DOCUMENTS

| | | | |
|---|---|---|---|
| 1,369,966 | 3/1921 | Cosens et al. | 15/167.1 |
| 1,901,646 | 3/1933 | Hicks | 15/167.1 |
| 2,305,461 | 12/1942 | Spyra | 15/167.1 |
| 2,567,080 | 9/1951 | Pifer | 15/167.1 |
| 2,849,740 | 9/1958 | Pauker | 15/167.1 |
| 3,359,588 | 12/1967 | Kobler | 15/110 |
| 3,722,020 | 3/1973 | Hills | 15/167.1 |
| 4,010,509 | 3/1977 | Huish | 15/167.1 |
| 4,115,894 | 9/1978 | Peterson | 15/167.1 |
| 4,706,322 | 11/1987 | Nicolas | 15/106 |
| 4,724,569 | 2/1988 | Eguchi et al. | 15/167.1 |
| 4,724,570 | 2/1988 | Hitzman | 15/167.1 |
| 4,776,054 | 10/1988 | Rauch | 15/167.1 |
| 4,852,202 | 8/1989 | Ledwitz | 15/167.1 |
| 5,040,260 | 8/1991 | Michaels | 15/167.1 |
| 5,046,213 | 9/1991 | Curtis et al. | 15/167.1 |

FOREIGN PATENT DOCUMENTS

| | | | |
|---|---|---|---|
| 1100290 | 9/1955 | France | 15/167.1 |
| 1296557 | 5/1962 | France | 15/167.1 |
| 17666 | 7/1896 | United Kingdom | 15/167.1 |

*Primary Examiner*—Mark Spisich
*Attorney, Agent, or Firm*—Milton L. Honig

[57] ABSTRACT

A toothbrush is described whose head has a special arrangement of bristle tufts. The arrangement includes a fan-shaped grouping of tufts along left and right edges of the head. Near front and rear ends of the head are a grouping of tufts whose free ends are trimmed to define respective planes slanting downwardly towards the interior area of the head. Within the interior area is a further grouping of tufts arranged in a saddle-shape.

11 Claims, 2 Drawing Sheets

MULTI-LEVEL BRISTLE TUFT TOOTHBRUSH

BACKGROUND OF THE INVENTION

1. Field of the Invention

The invention relates to a toothbrush with a special head that provides improved removal of dental plaque while massaging and stimulating the gums without injury to these tissues.

2. The Related Art

There is a rich literature available on toothbrush design. Many different types of approaches have been reported in the patent literature to improve cleaning, gum stimulation and mouthfeel.

U.S. Pat. No. 2,567,080 (Pifer) prescribes an arrangement where an outer row of tufts on each of the left and right sides of a head diverge away from one another. These outer rows are also inclined away from a central row. Broad spacings are left between adjacent tufts to allow the bristles to achieve full lateral flexing without interference that would normally occur with closely packed adjacent tufts.

A similar concept is disclosed in U.S. Pat. No. 3,359,588 (Kobler) wherein a massage head is formed from a series of conical teeth in rows divergently angled away from one another. This concept is also found in U.S. Pat. No. 4,010,509 (Huish) that describes a double sulcus toothbrush having two groups of sulcus bristles that diverge at an angle relative to one another.

Alternating adjacent tufts of perpendicular and inclined bristles are reported in U.S. Pat. No. 3,722,020 (Hills), U.S. Pat. No. 4,706,322 (Nicolas) and U.S. Pat. No. 5,046,213 (Curtis et al.). A commercial embodiment of the latter patent is produced by the Colgate-Palmolive Company under the Precision trademark.

U.S. Pat. No. 4,776,054 (Rauch) reports a brushhead with parallel slits separating outer rows from central inner rows. Length of bristles in the outer rows are approximately one third greater than that of bristles of the center rows. At least one embodiment illustrates a curvilinear arrangement of an outer row of bristles.

Back molar teeth are reported to be more readily cleanable in U.S. Pat. No. 1,369,966 (Cosens et al.) through provision of a front tuft of greater length than those rearward. Longitudinally, the head is formed concave while transversely it is convex.

U.S. Pat. No. 4,724,570 (Hitzman) and U.S. Pat. No. 4,724,569 (Eguchi et al.) describe brushheads with tufts whose heads have been angularly cut. The angular cut concept is also illustrated in U.S. Pat. No. 5,040,260 (Michaels).

Oral-B Laboratories sells a toothbrush under the Advantage trademark. This toothbrush has a head with a group of tufts near the front area which are of greater length than those rearward towards the handle. Free ends of these tufts have been trimmed at an angle which describes a plane inclined towards the rear. Tufts rearward of the front group alternate in length to form what is advertised as an action cup.

There have been many innovations in this area as can be seen through the technology of the above briefly described patents. Nevertheless, there remains room for improved models.

Accordingly, it is an object of the present invention to provide a toothbrush which efficiently cleans teeth to remove debris and bacterial plaque.

It is another object of the present invention to provide a toothbrush that can stimulate gums in an optimum manner so as to prevent gum disease without injuring the gums.

Still another object of the present invention is to provide a toothbrush that can impart a unique mouth sensation signaling to the consumer effective cleaning and providing a tactile massage effect.

SUMMARY OF THE INVENTION

A toothbrush is provided that includes:

a handle with a first and second end;

a head with front and rear ends positioned along a longitudinal axis, the rear end being connected with the second end of the handle, the head having a lower surface, a flat upper surface opposite the lower surface, and side surfaces joining the lower and upper surfaces, the side surfaces being bordered by left and right edges; and a plurality of tufts of bristles each with one end anchored into the upper surface of the head and a free end opposite the anchored one, the tufts of bristles including:

one row of outer tufts arranged adjacent the left edge along the longitudinal axis and another row of outer tufts arranged adjacent the right edge, each of the rows of outer tufts being positioned along the longitudinal axis and slanting outwardly toward the respective edges away from one another, each row being fan-shaped wherein a middle tuft is of longest height, as measured from free to anchored ends, and is flanked on each side by at least three tufts with tuft heights becoming progressively smaller with distance from the middle tuft.

Three rows of rear tufts are arranged near an area of the rear end of the head, each row being defined by a plane, each of the planes arranged transverse to the longitudinal axis. These three rows of rear tufts are positioned closer to the rear end than a smallest tuft of the outer row.

Complementary to this arrangement, there are three rows of front tufts positioned near the front end of the head, each row being defined by a plane, each of these planes also arranged transverse to the longitudinal axis. Each of the three rows of front tufts are positioned closer to the front end than the smallest tuft of the outer row.

Each row of the three rear tuft rows, beginning rearmost, becomes progressively shorter in height proceeding closer to the front end. Likewise, each row of the three front tuft rows, beginning frontmost, becomes progressively shorter in height proceeding closer to the rear end.

Free ends of the rear tufts are trimmed in such a manner as to define a plane, this plane being slanted downward towards the front end. Free ends of the front tufts also define a plane, this plane being slanted downward towards the rear end.

Further, there is provided a plurality of interior rows of tufts, positioned between the outer rows of fan-shaped tufts.

A first of the interior rows is adjacent the front tufts, a last of the interior rows being adjacent the rear tufts and a plurality of intermediate rows positioned between the first and last rows. Tufts of the first and last rows are of greater height than tufts of the intermediate rows thereby forming a saddle-shaped center area of the head.

The free ends of tufts comprising the first and last of the interior rows are trimmed to define an inwardly slanting plane.

BRIEF DESCRIPTION OF THE DRAWING

The above features, advantages and objects of the present invention will more fully be appreciated through the following detailed discussion, reference being made to the drawing consisting of.

DETAILED DESCRIPTION

Improved cleaning, gum stimulation and mouthfeel have been achieved through a combination of varying bristle tuft heights, angling and positional arrangement. Bristles along the outer perimeter of the head have been inclined at an outward angle and arranged in a fan-shaped sequence. Multi-level height tufts have been arranged in groups at rear and front areas of the head. Within an interior section of the head, another set of multi-level height tufts have been assembled into a saddle-shape or concave bowl. These combinations of features have been found to result in optimum performance based on tests with numerous alternate variations of tuft heights and positioning.

Figure 1:
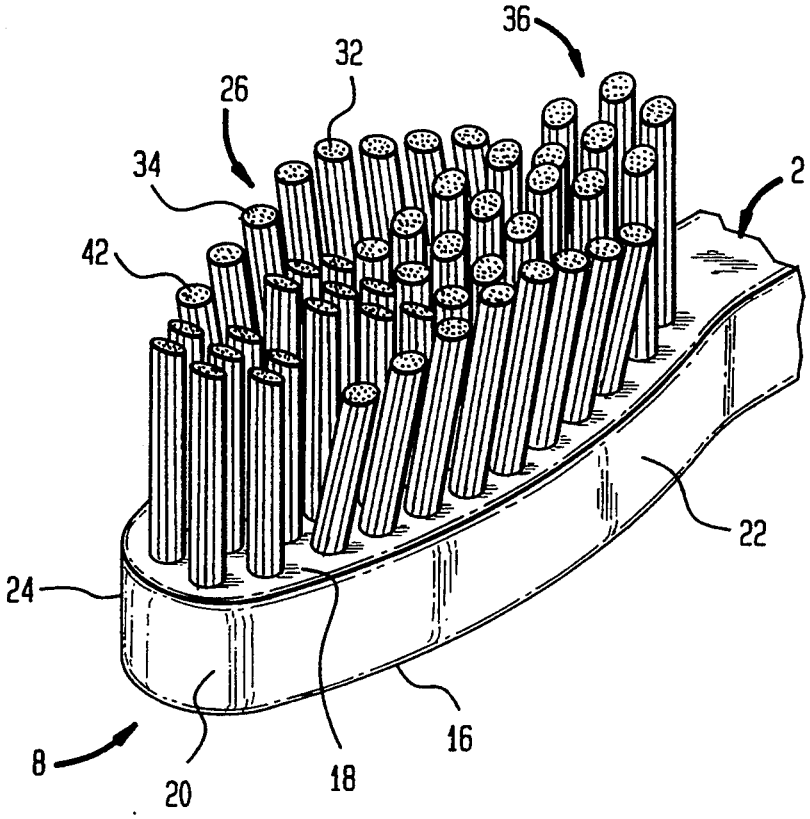
FIG. 1 which is a plan perspective view of the toothbrush head.

FIG. 1 illustrates one embodiment according to the present invention. Shown is a handle 2 with a first end 4 and a second end 6. A head 8 with front end 10 and rear end 12 is positioned along a longitudinal axis 14. Rear end 12 is connected to the second end 6 of the handle 2. Head 8 is defined by a lower surface 16, a flat upper surface 18 opposite the lower surface and side surfaces 20 joining the lower and upper ones. Left and right edges 22, 24 border respective sides of head 8.

Figure 2:
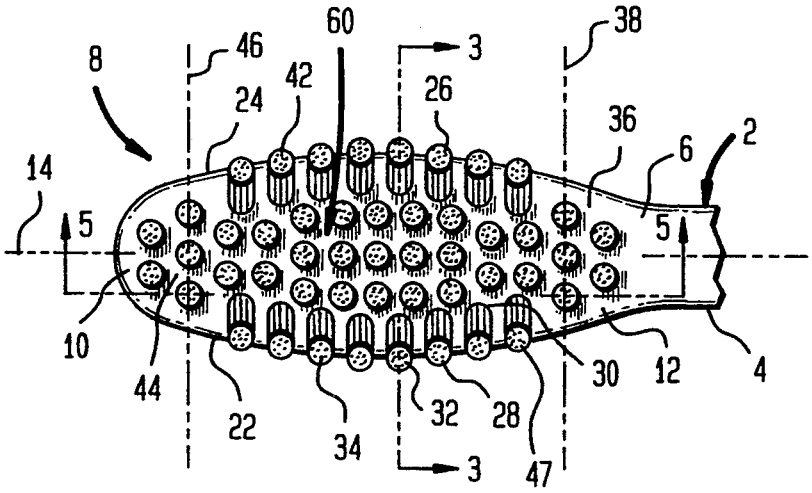
FIG. 2 which is a top plan view of the toothbrush according to FIG. 1.
Figure 3:
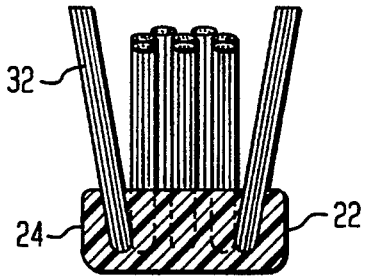
FIG. 3 which is a cross-sectional view along line 3—3 of FIG. 2.

FIG. 2 provides the best view of bristle tuft positioning on the head. One row of outer tufts 26 is arranged adjacent the left edge 22 and astride the longitudinal axis 14. Another row of outer tufts are arranged adjacent the right edge 24 and also positioned astride the longitudinal axis. Each of the outer tuft rows as shown in FIG. 3 slant outwardly toward their respective adjacent edges and away from one another. Each bristle has a free end 28 and an anchored end 30, the latter being held within an aperture of the head together with other bristles in a bundle forming a tuft.

The row of outer tufts 26 together define a fan-shaped grouping. Within the grouping is a middle tuft 32 separating two groupings of three adjacent tufts 34 each flanking one side of the middle tuft. This middle tuft 32 has a longer height, as measured from free to anchored end, than any of the adjacent tufts 34. Heights of each of the adjacent tufts 34 progressively decrease with distance from the middle tuft 32.

Figure 4:
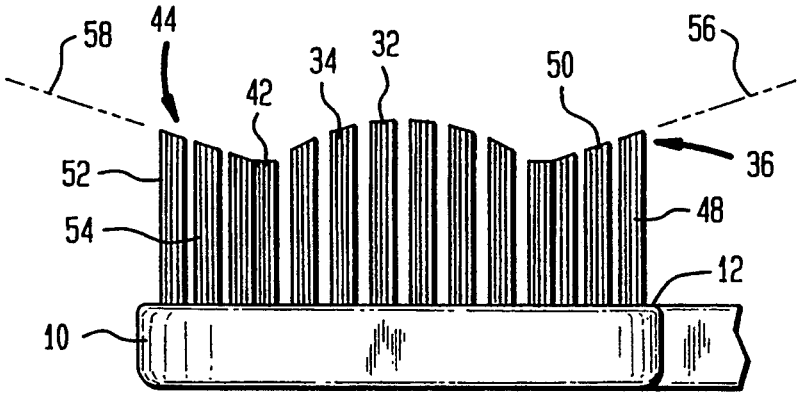
FIG. 4 which is a side elevational view highlighting the fan-shape outer row of tufts according to FIG. 1.

FIG. 4 best illustrates the further feature of three rows of rear tufts 36 arranged proximate to rear end 12 of head 8. Each of these rows of rear tufts 36 lie within a plane 38 transverse to longitudinal axis 14. See FIG. 2. The three rows of rear tufts 36 are located closer to the rear end 12 than is the smallest of the outer tufts 47.

Near the front end 10 of head 8 are a set of three rows of front tufts 44. Each of these rows also lie within a plane transverse to the longitudinal axis 14. The three rows of front tufts 44 are located closer to the front end 10 of head 8 than is the smallest tuft: of the outer tufts 42.

Furthermore, each row of the three rear tuft rows 36 beginning with rearmost row 48 is progressively shorter than a preceding row. For example, row 50 is shorter than row 48, the former being closer to the front end 10 of head 8. Likewise, each row of the three front tuft rows 44 beginning with frontmost row 52 is progressively shorter in length than a preceding row. For example, row 54 is shorter than row 52, the former being closer to the rear end 12 of head 8.

A slanted plane 56 defines the grouping of trimmed free ends of the rear tufts 36. This slanted plane 56 is inclined downwards toward the front end 10. In similar fashion, a slanted plane 58 defines the grouping of trimmed free ends of the front tufts 44. This slanted plane 58 is inclined downwards toward the rear end 12.

Figure 5:
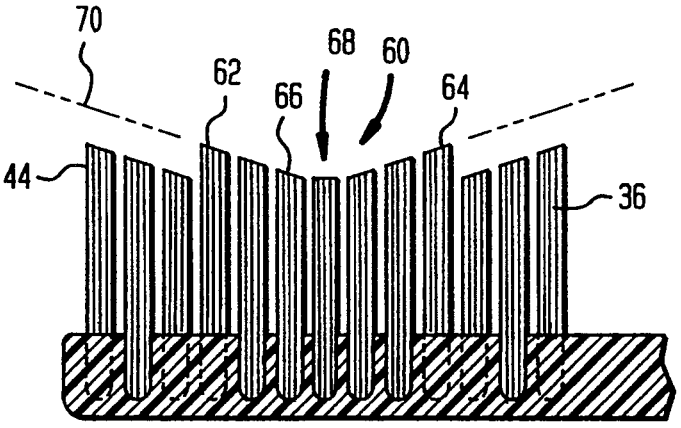
FIG. 5 which is a cross-sectional view along line 5—5 of FIG. 2 illustrating the saddle arrangement formed by the interior rows of tufts.

FIG. 5 best illustrates the saddle-shaped arrangement that includes a plurality of rows of interior tufts 60 positioned between the pair of outer tuft rows 26 that form the fan-shape. A first of the rows of interior tufts 62 is adjacent the front tufts 44 while a last of the interior rows 64 is adjacent the rear tufts 36. A plurality of intermediate rows 66 are positioned between the first and last rows 62, 64. Tufts of these first and last rows have bristles of greater height than those of the intermediate rows. This arrangement of tufts forms a saddle-shaped configuration within a center area 68 of the head 8. Finally, the free ends of tufts comprising the first and last of the interior rows 62, 64 are trimmed to define an inwardly slanting plane 70.

Toothbrushes according to the present invention with the special tuft pattern and contour trim provide superior bristol contact on tooth surfaces and hard to clean crevasses for enhanced plaque removal. Three sub-arrangements of bristles achieve the special functional effect; namely the gumline bristles, interproximal and surface bristles, and the leading tip bristles.

Gumline bristles are embodied in outer tufts 26. These tufts are angled outward from edges 22, 24 of head 8 so that they project toward the gumline (gingival margin) at the base of the teeth. As downward force is applied to the brushhead, these angled tufts tend to flair toward and below the gumline. The arched trim of these perimeter bristles, combined with the outward angle result in a soft, automatic bristle action that tracks bristle tips along normally irregular contours of the gumline. Conventional straight tufted brushes require a user to orient the brush at a 45° angle to effectively clean the gumline. When a conventional brush is oriented to optimize gumline cleaning, other areas of the teeth are less effectively accessed.

Interproximal and surface bristles are the second important sub-arrangement present in toothbrushes according to this invention. The interior interproximal bristles and surface bristles are collectively embodied in rear tufts 36, front tufts 44 and interior tufts 60. Together they remove plaque from triangular spaces between adjoining teeth and from the broad tooth surfaces. Multi-sloped trim as embodied in slanted planes 56, 58 and 70, enhance bristle access to the uneven dental topography. This configuration of long and short bristle tufts delivers a dynamic action when downward force and horizontal motion are applied to the brushhead. The longer interproximal bristles deeply penetrate spaces between the teeth. Shorter bristles have increased stiffness maximizing cleaning contact with tooth surfaces. By contrast, flat trimmed bristle tufts on conventional brushes curl in opposite direction to which they are pushed as they are swept across broad tooth surfaces. These bristles of equal length tend to act in unison, suspending bristle tips over crevasses between teeth. The combined structural support of these bristles inhibit tufts from penetrating interproximal spaces.

Leading tip bristles, the third functional group of tufts, is embodied in front tufts 44. These tufts are arranged near the tip of the brush. They are configured in a radial pattern that is comparably narrower than other tuft groups on the brushhead. This arrangement allows the head to be tapered for increased rear mouth access. Sloped trim on front tufts 44 provides superior reach thereby maximizing plaque removal on back sides of the rear molars. By contrast, conventional flat trimmed brushes and brushes that do not taper at the tip limit access to the back of the mouth. Rear surfaces of back molars are therefore virtually unreachable.

The present invention may be embodied in other specific forms without departing from its spirit or essential characteristics. The described embodiments are to be considered in all respects only as illustrative and not restrictive. The scope of the invention is, therefore, indicated by the appended claims rather than the foregoing description. All changes which come within the meaning and range of equivalency of the claims are to be embraced within their scope.

What is claimed is:

1. A toothbrush comprising:

an elongated handle with a first and second end;

an elongated head with front and rear ends positioned along the longitudinal axis of the head, the rear end being connected with the second end of the handle, the head having a lower surface, a flat upper surface opposite the lower surface and side surfaces joining the lower and upper surfaces, the side surfaces being bordered by left and right edges adjacent the flat upper surface; and a plurality of tufts of bristles each with one end anchored into the upper surface of the head and a free end opposite the anchored end, the tufts of bristles comprising:

one row of outer tufts arranged adjacent the left edge and another row of outer tufts arranged adjacent the right edge, each of the rows of outer tufts being positioned astride the longitudinal axis and slanting outwardly toward the respective edges away from one another, each row being fan-shaped wherein a middle tuft of longest height, as measured from free to anchored ends, is flanked on each side by at least three tufts with the tuft heights becoming progressively smaller with distance from the middle tuft; and three rows of rear tufts near the rear end of the head, each of the three rows of rear tufts defining a plane transverse to the longitudinal axis, each of the three rows of rear tufts being arranged closer to the rear end than is the smallest tuft of the outer rows adjacent the rear end, and the tufts of each of the three rear tuft rows becoming progressively shorter from the rearmost row toward the front end of the head.

2. A toothbrush according to claim 1 further comprising near the front end of the head three rows of front tufts, each row defining a plane transverse to the longitudinal axis.

3. A toothbrush according to claim 2 wherein each of the three rows of front tufts are arranged closer to the front end than is the smallest tuft of the outer rows adjacent the front end.

4. A toothbrush according to claim 2 wherein the tufts of each of the three front tuft rows become progressively shorter from the frontmost row toward the rear end of the head.

5. A toothbrush according to claim 1 wherein a plane defined by the free ends of the rear tufts-is slanted downward towards the front end.

6. A toothbrush according to claim 2 wherein a plane defined by the free ends of the front tufts is slanted downward towards the rear end.

7. A toothbrush according to claim 2 further comprising a plurality of interior rows of tufts positioned between the outer rows of fan-shaped tufts.

8. A toothbrush according to claim 7 wherein a first of the interior rows is adjacent the front tufts, a last of the interior rows is adjacent the rear tufts and a plurality of intermediate rows positioned between the first and last rows, tufts of the first and last rows being taller than those of the intermediate rows thereby forming with the free tuft ends thereof a saddle-shaped center area of the head.

9. A toothbrush comprising:

an elongated handle with a first and second end;

an elongated head with front and rear ends positioned along the longitudinal axis of the head, the rear end being connected with the second end of the handle, the head having a lower surface, a flat upper Surface opposite the lower surface and side surfaces joining the lower and upper surfaces, the side surfaces being bordered by left and right edges adjacent the flat upper surface; and a plurality of tufts of bristles each with one end anchored into the upper surface of the head and a free end opposite the anchored end, the tufts of bristles comprising:

one row of outer tufts arranged adjacent the left edge and another row of outer tufts arranged adjacent the right edge, each of the rows of outer tufts being positioned astride the longitudinal axis and slanting outwardly toward the respective edges away from one another, each row being fan-shaped wherein a middle tuft of longest height, as measured from free to anchored ends, is flanked on each side by at least three tufts with the tuft heights becoming progressively smaller with distance from the middle tuft; and three rows of rear tufts near the rear end of the head, each row of rear tufts defining a plane transverse to the longitudinal axis, each of the three rows of rear tufts being arranged closer to the rear end than is the smallest tuft of the outer rows adjacent the rear end; and three rows of front tufts near the front end of the head, each row of front tufts defining a plane transverse to the longitudinal axis, the tufts of each of the three front tuft rows becoming progressively shorter from the frontmost row toward the rear end of the head.

10. A toothbrush comprising:

an elongated handle with a first and second end;

an elongated head with front and rear ends positioned along the longitudinal axis of the head, the rear end being connected with the second end of the handle, the head having a lower surface, a,flat upper surface opposite the lower surface and side surfaces joining the lower and upper surfaces, the side surfaces being border, ed by left and right edges adjacent the flat upper surface; and a plurality of tufts of bristles each with one end anchored into the upper surface of the head and a free end opposite the anchored end, the tufts of bristles comprising:

one row of outer tufts arranged adjacent the left edge and another row of outer tufts-arranged adjacent the right edge, each of the rows of outer tufts being positioned astride the longitudinal axis and slanting outwardly toward the respective edges away from one another, each row being fan-shaped wherein a middle tuft of longest height, as measured from free to anchored ends, is flanked on each side by at least three tufts with the tuft heights becoming progressively smaller with distance from the middle tuft; and three rows of rear tufts near the rear end of the head, each row of rear tufts defining a plane transverse to the longitudinal axis, each of the three rows of rear tufts being arranged closer to the rear end than is the smallest tuft of the outer rows adjacent the rear end, a plane defined by free ends of the rear tufts being slanted downward from the rear end towards the front end.

11. A toothbrush comprising:

an elongated handle with a first and second end;

an elongated head with front and rear ends positioned along the longitudinal axis of the head, the rear end being connected with the second end of the handle, the head having a lower surface, a flat upper surface opposite the lower surface and side surfaces joining the lower and upper surfaces, the side surfaces being bordered by left and right edges adjacent the flat upper surface; and a plurality of tufts of bristles each with one end anchored into the upper surface of the head and a free end opposite the anchored end, the tufts of bristles comprising:

one row of outer tufts arranged adjacent the left edge and another row of outer tufts arranged adjacent the right edge, each of the rows of outer tufts being positioned astride the longitudinal axis and slanting outwardly toward the respective edges away from one another, each row being fan-shaped wherein a middle tuft of longest height, as measured from free to anchored ends, is flanked on each side by at least three tufts with the tuft heights becoming progressively smaller with distance from the middle tuft;

three rows of rear tufts near the rear end of the head, each row of rear tufts defining a plane transverse to the longitudinal axis, each of the three rows of rear tufts being arranged closer to the rear end than is the smallest tuft of the outer rows adjacent the rear end; and a plurality of interior rows of tufts positioned between the outer rows of fan-shaped tufts, a first of the interior rows being adjacent the front end of the head, a last of the interior rows being adjacent the rear tufts and a plurality of intermediate rows positioned between the first and last rows, tufts of the first and last rows being taller than those of the intermediate rows thereby forming with the free tuft ends thereof a saddle-shaped center area of the head.

* * * * *